United States Patent [19]

Hopkins

[11] 4,422,634

[45] Dec. 27, 1983

[54] SWIMMING SIMULATOR

[76] Inventor: Harry C. Hopkins, 15 Lafayette St., White Plains, N.Y. 10606

[21] Appl. No.: 271,390

[22] Filed: Jun. 8, 1981

[51] Int. Cl.[3] ..... A63B 69/10

[52] U.S. Cl. ..... 272/71

[58] Field of Search ..... 272/71, 130; 128/25 R; 434/254

[56] References Cited

U.S. PATENT DOCUMENTS

| | | | |
|---|---|---|---|
| 1,966,448 | 7/1934 | Kabisius | 272/71 |
| 1,990,124 | 2/1935 | Kabisius | 272/71 |
| 2,109,775 | 3/1938 | Hudson | 272/71 |
| 2,332,184 | 10/1943 | Sweeney | 272/71 UX |
| 3,074,716 | 1/1963 | Mitchel et al. | 272/71 |
| 4,063,726 | 12/1977 | Wilson | 272/130 |
| 4,191,370 | 3/1980 | Meyer et al. | 272/130 X |

FOREIGN PATENT DOCUMENTS

| | | | |
|---|---|---|---|
| 629365 | 3/1963 | Belgium | 272/71 |
| 517703 | 2/1931 | Fed. Rep. of Germany | 272/71 |
| 2409469 | 9/1975 | Fed. Rep. of Germany | 272/71 |
| 6413494 | 5/1966 | Netherlands | 272/71 |

*Primary Examiner*—William H. Grieb

*Attorney, Agent, or Firm*—Darby & Darby

[57] ABSTRACT

A swimming simulator provides a user with the exercise typically provided by swimming. This simulator includes a support frame from which arm and leg levers project. The arm levers are extendable from the front of the frame against the resistance of springs and are pivotable transversely to the frame. Grip handles at the ends of the arm levers are rotatable against another predetermined resistance. Also, the leg levers are movable in an arc against a further predetermined resistance.

9 Claims, 4 Drawing Figures

SWIMMING SIMULATOR

BACKGROUND OF THE INVENTION

The present invention relates to exercise machines and, more particularly, to stationary exercise machines that duplicate some mobile physical activity.

Exercises have been prescribed by physicians for many years as a means of improving muscle tone, including that of the heart, and losing weight. Some of the more effective of these exercises, however, require expensive apparatus and/or considerable space out-of-doors. For example, bicycle riding and skiing can require expensive equipment and a relatively large amount of roadway or mountain. Even if these are available, they cannot be used during inclement weather.

Swimming is also a very healthful exercise, but it requires a pool, which represennts an extraordinary expense either in terms of purchase price or a membership in a club having a pool. Also, unless the pool is located indoors, it cannot be used in inclement weather.

With respect to bicycle riding and rowing, various devices have appeared on the market which simulate these types of exercise. These devices are in the form of mechanical gyms that can be located in the user's home or apartment because they are basically stationary and take up little room.

SUMMARY OF THE INVENTION

The present invention is directed to the problem of providing the exercise obtained by swimming without the expense and inconvenience of using a swimming pool. This object is accomplished with a stationary mechanical gym that simulates the exercise achieved by swimming.

In an illustrative embodiment of the invention the swimming simulator includes a stationary support frame resting on a foundation and supporting the torso of the user in a horizontal position at a distance above the foundation. At least two arm levers extend from a front part of the support frame, which levers have transverse grip handles for the user's hands at their ends. These levers are extendable from the frame against a predetermined resistance and the grip handles are rotatable against a certain resistance in a circular path. Leg levers are also pivoted to the rear of the support frame in a position to contact the legs of the user. Each leg lever is movable up and down in an arc against another predetermined resistance.

In a preferred embodiment of the invention the extendable arm levers are also pivotable in the transverse direction of frame in order to separate the arm levers, whereby an exercise motion more closely resembling swimming using different strokes, e.g. breast stroke, is achieved. Also, the leg levers may include foot pads that can be attached to the foot or lower leg of the user so that lifting of the user's leg as well as lowering of it during a swimming exercise is against the predetermined resistance applied to the leg levers. Further, an inflatable cushion connected to one or more air pumps driven by the arm and leg levers, may be provided on the support frame to cause the user's body to rise when swimming strokes are rapid and to fall when they are slow.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
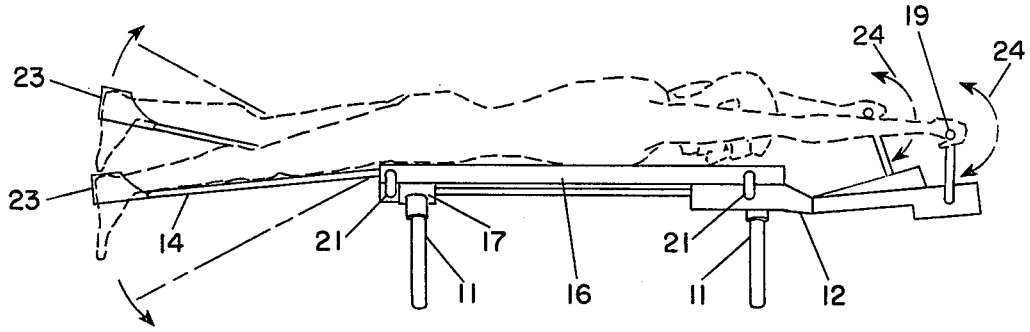
FIG. 1 is a side view of the invention showing the position of a user thereon.

The swimming simulator shown in the figures has a main frame 10 which may be made from light weight metal tubular or channel members formed into a ladder-like structure extending along a longitudinal axis. Legs 11 extend from the frame to a support surface and hold the frame stationary during use, although it is readily portable when not in use.

At the front of frame 10 is a front part or chamber 12, having a front wall with an opening in it, from which extendable lever supports 18 project. Near the outer ends of these lever supports, arm crank levers 19 with user grip handles are positioned. Each of the lever supports has a longitudinal slot which is guided by pivot pins 15 located in the chamber 12. As a result, the supports may be moved at an angle to each other as shown in dashed-line (Position C) in FIG. 2 and solid line in FIG. 3. Also in this chamber there are springs 13 which are connected to an end wall of the chamber and urge the lever supports to align with each other and to move within the chamber to the extent permitted by the slots. Thus, the lever supports are extendable from chamber 12 against the resistance offered by springs 13.

Figure 4:
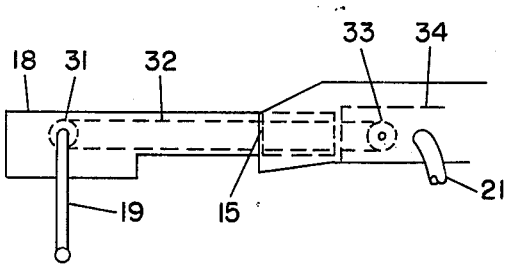
FIG. 4 is a schematic view of the interior of a lever support and front chamber showing operation of an air compressor.

The crank levers 19 are also connected to some form of resistance. As shown in FIG. 4 each crank lever may be connected to a sproket or wheel 31 within its support. This sprocket 31 may in turn be attached, via an elastic band 32 extending the length of the support, to a wheel or sprocket 33 of a compressor or air pump 34 located in chamber 12. The air pump thus provides the resistance desired for the crank lever.

At the end of frame 10 there is a rear part or chamber 17 which has leg levers 14 pivotally attached thereto, so that the levers 14 may be moved over a portion of an arc of a circle as shown by arrows 20. Within the rear part or chamber 17 there is some form of resistance to the movement of the levers 14, which resistance may be, for example, some form of air pump or compressor 40 driven by the motion of the two levers via ratchet gears 41 connected to a common shaft 42 of such a compressor (shown in dotted line in FIGS. 2 and 4).

The air pumps in chambers 12 and 17 are connected by tubes 21 to cushion 16. A lower portion 16' of the thickness of the cushion 16 may be made of a resilient foam rubber or other similar material. The upper portion 16" of the thickness is in the form of an air bladder with a relief orifice or valve 22 that allows for the release of a small uniform amount of air from the bladder. Thus, the faster a user turns arm crank levers 19 and moves leg levers 14, the more cushion 16 will inflate. If this motion is slowed so that the air flow created by the air pumps is less than that which is leaking out of the bladder through valve 22, the cushion will deflate.

Figure 2:
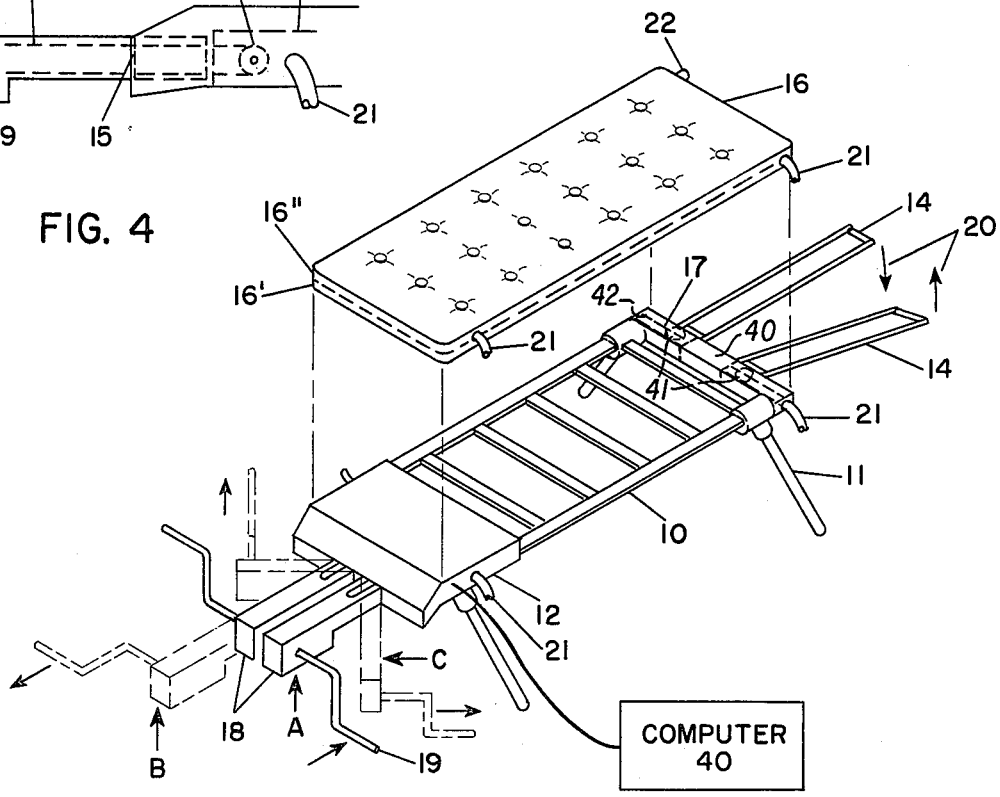
FIG. 2 is a perspective view of the invention with its support cushion raised above the frame.

Assuming that the user desires to simulate a crawl swim stroke, he takes the position shown in FIG. 1 and the lever supports 18 are held parallel to each other as shown in solid line in FIG. 2. As the hand-over-hand motion of the crawl stroke is simulated, first one and then the other of the lever supports are alternatively pushed forward by the user's hands against the resistance of springs 13 as shown in dashed lines in FIGS. 2 and 3 (Positions A and B in FIG. 2). At the same time the arm cranks 19 are rotated to complete the hand-over-hand motion of the crawl stroke. The leg levers 14 are moved up and down to simulate the butterfly kick which normally accompanies this stroke.

In order to assist in the movement of the leg levers in the upward direction during the butterfly kick, foot supports 23 may be provided. These foot supports connect the user's feet or lower legs to the leg levers. The motion of the arm and leg levers causes the bladder of cushion 16 to inflate if the volume of air created by the associated air pumps is larger than that discharged through valve 22. The faster these levers are operated, the more the bladder will inflate and the farther up the user will be lifted, thereby simulating actual swimming.

Figure 3:
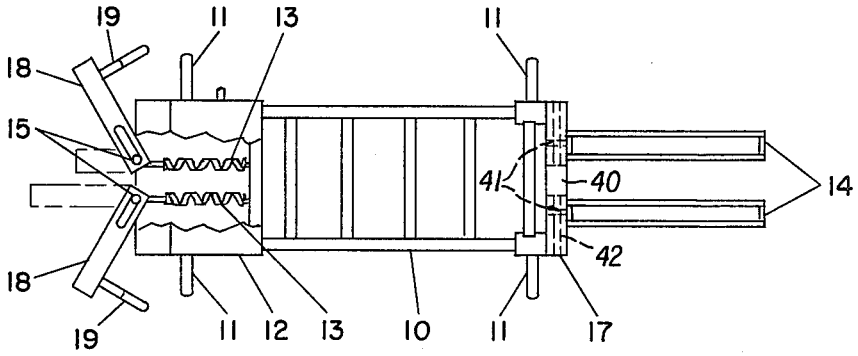
FIG. 3 is a top view of the invention.

If a breast stroke is to be simulated, the lever supports 18 are pushed out together and then are swung out to the side (Position C in dashed line in FIG. 2 and solid line in FIG. 3). Simultaneously the crank levers are moved in a circular path and the leg levers are moved up and down together in order to fully simulate the breast stroke and to pump air into the cushion. This action is shown by arrows 24 in FIG. 1. If the user lies on his back on the frame 10, various types of back stroke can also be accomplished.

The springs 13 in front chamber 12 are adjustable so as to change the amount of force applied to support levers 18. Likewise the air pumps associated with the arm and leg levers are adjustable so as to increase or decrease the amount of resistance offered by these levers.

In a more sophisicated version of the simulator, sensors may be attached to the frame to monitor the speed achieved and the resistance overcome by the user. This sensor information may be directed to a physical fitness computer 40 to calculate the amount of work done (i.e. calories expended), the equivalent swimming distance covered and the period over which the exercise was conducted. Further, a sensor may be provided to monitor the user's heart rate as a safety device or as a means of monitoring the effect of the exercise in improving cardiac performance over a period of time.

While the invention has been particularly shown and described with reference to a preferred embodiment thereof, it will be understood by those skilled in the art that various changes in form and details may be made therein without departing from the spirit and scope of the invention.

I claim:

1. A swimming simulator for providing a user with the exercise typically produced by swimming, comprising:

support frame having a longitudinal axis resting on a foundation and supporting the torso of the user in a horizontal position at a distance above the foundation;

a pair of arm levers with a longitudinal axis and being extendable from a front part of said support frame, said arm levers including a pair of grip handles adapted to be seized by the user's hands and extending transversely from the longitudinal axis of said arm levers, said grip handles being movable along a circular path against a first predetermined resistance;

a pair of leg levers extending from a rear part of said support frame in a position to contact the legs of the user, the end of each of said leg levers being movable in an arc about a rear pivot point at the other end, such movement being against a second predetermined resistance; and at least one air pump means connected by a mechanical coupling to at least one of said pair of grip handles and said pair of leg levers for operating said air pump means and providing at least one of said first and second predetermined resistances.

2. A swimming simulator as claimed in claim 1, further including springs located with said front part and wherein said arm levers comprise:

arm lever supports extendable from the front part of said support frame against the resistance of said springs, and arm crank levers attached to the ends of said lever supports at positions remote from the front part, the arm crank levers having the grip handles at their ends.

3. A swimming simulator as claimed in claim 2, wherein said arm lever supports are pivotable about pivot pins in said front part in a direction transverse to the longitudinal axis of the support frame, said arm lever supports containing longitudinal slots within which the pivot pins are located so as to permit them to be extendable from said front part.

4. A swimming simulator as claimed in claim 2 further including sensors for monitoring at least one of the speed of motion of the arm lever supports, the arm crank levers, and the leg levers, as well as the predetermined resistances, and generating signals related thereto, and a computer for receiving the signals from the sensors and calculating the amount of work accomplished by the user in performing exercises on the simulator based on these signals.

5. A swimming simulator as claimed in claim 1 further including a cushion having a particular thickness and located on the support frame in a position to receive the torso of the user.

6. A swimming simulator as claimed in claim 5, wherein a portion of the thickness of the cushion is comprised of an inflatable bladder.

7. A swimming simulator as claimed in claim 6 wherein said at least one air pump means is located in said support frame and further including:

a bladder of said cushion connected to said air pump air output such that motion of at least one of the grip hands and leg levers causes said air pump to inflate said bladder, and a relief valve located in said bladder for releasing a constant volume of air over a period of time.

8. A swimming simulator as claimed in claim 1, wherein the mechanical coupling includes a first wheel rotatable by said grip handles and located in said arm levers, a second wheel located on the air pump, and an elastic band coupling said first and second wheels for transmitting the rotation of the first wheel to the second wheel and permitting translatory movement of the first wheel with respect to the second wheel.

9. A swimming simulator as claimed in claim 1, wherein the leg levers include foot supports at their ends, which foot supports are adapted to receive and hold the feet of the user.

* * * * *